US011137219B2

(12) United States Patent
Riondet et al.

(10) Patent No.: US 11,137,219 B2
(45) Date of Patent: Oct. 5, 2021

(54) ANNULAR SEAL FOR MOTOR VEHICLE HEAT EXCHANGER

(71) Applicant: Valeo Systemes Thermiques, Le Mesnil Saint-Denis (FR)

(72) Inventors: Christian Riondet, Reims (FR); Jean-Marc Lesueur, Reims (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 8 days.

(21) Appl. No.: 15/569,501

(22) PCT Filed: Apr. 22, 2016

(86) PCT No.: PCT/EP2016/058973
§ 371 (c)(1),
(2) Date: Oct. 26, 2017

(87) PCT Pub. No.: WO2016/173934
PCT Pub. Date: Nov. 3, 2017

(65) Prior Publication Data

US 2018/0299212 A1 Oct. 18, 2018

(30) Foreign Application Priority Data

Apr. 27, 2015 (FR) ..... 1553744

(51) Int. Cl.
*F28F 9/16* (2006.01)
*F28F 9/02* (2006.01)
(Continued)

(52) U.S. Cl.
CPC ..... *F28F 9/165* (2013.01); *F28D 7/0066* (2013.01); *F28F 9/0226* (2013.01); *F28D 1/05366* (2013.01)

(58) Field of Classification Search
CPC .. F28F 9/165; F28F 9/0226; F28F 9/04; F28F 9/185; F28F 9/187; F28D 7/0066; F28D 1/05366
(Continued)

(56) References Cited

U.S. PATENT DOCUMENTS 2,656,155 A * 10/1953 Garratt ..... F28F 9/0224 165/79
4,546,822 A * 10/1985 Tamura ..... F28F 9/0226 165/149
(Continued)

FOREIGN PATENT DOCUMENTS

| | | |
|---|---|---|
| FR | 2 927 411 A1 | 8/2009 |
| FR | 2 984 475 A1 | 6/2013 |
| WO | 2013/007758 A1 | 1/2013 |

OTHER PUBLICATIONS

International Search Report issued in corresponding application No. PCT/EP2016/058973 dated Jun. 24, 2016 (4 pages).
(Continued)

*Primary Examiner* — Tho V Duong
*Assistant Examiner* — Raheena R Malik
(74) *Attorney, Agent, or Firm* — Osha Bergman Watanabe & Burton LLP

(57) ABSTRACT

An annular seal for a motor vehicle heat exchanger is configured to be stretched between two opposite supports that the annular seal surrounds. The annular seal includes two opposite support parts that cooperate with the two supports, two connecting parts joining the support parts together, and an annular bead that deforms elastically by axial compression perpendicular to a plane parallel to the annular shape of the seal. Additionally, said annular bead is extending in the support and connecting parts. Further, the cross section of the annular bead between each support part and the connecting parts to which the annular bead is joined
(Continued)

changes such that a radial dimension of the annular bead, measured in a median plane of the seal parallel to the annular shape of the seal, is smaller in the support part than in the connecting parts.

5 Claims, 3 Drawing Sheets

(51) Int. Cl.
*F28D 7/00* (2006.01)
*F28D 1/053* (2006.01)

(58) Field of Classification Search
USPC ..... 165/173
See application file for complete search history.

(56) References Cited

U.S. PATENT DOCUMENTS 4,546,823 A * 10/1985 Melnyk ..... F28F 9/0226 165/149
4,651,815 A * 3/1987 Logic ..... F28F 9/0226 165/148
4,997,035 A * 3/1991 Beatenbough ..... F28F 9/0226 165/149
5,076,557 A * 12/1991 Beatenbough ..... F16J 15/061 165/173
5,195,582 A * 3/1993 Haase ..... F28F 9/0226 165/149
5,201,368 A * 4/1993 Kroetsch ..... F28F 9/0226 165/149
5,845,705 A * 12/1998 Vinh ..... F28D 1/05391 165/173
5,979,546 A * 11/1999 Stolarski ..... F28F 9/0226 165/149
6,082,439 A * 7/2000 Kato ..... F28F 9/0226 165/173
6,082,446 A * 7/2000 Ahaus ..... F28F 9/0226 165/149
6,971,444 B2 * 12/2005 Lamich ..... F28D 1/05366 165/173
8,863,384 B2 * 10/2014 Satou ..... B23P 15/26 29/450
2006/0061044 A1 * 3/2006 Merklein ..... F28F 9/0226 277/510
2008/0053645 A1 * 3/2008 Hakamata ..... F28F 9/0226 165/173
2008/0121386 A1 * 5/2008 Hakamata ..... B21D 53/02 165/173
2012/0097379 A1 * 4/2012 Riondet ..... F28F 9/0226 165/173
2015/0233654 A1 * 8/2015 Farlow ..... F28F 9/0226 165/173
2018/0202720 A1 * 7/2018 Takeuchi ..... F01P 3/18

OTHER PUBLICATIONS

Written Opinion of the International Searching Authority issued in corresponding application No. PCT/EP2016/058973 dated Jun. 24, 2016 (4 pages).

* cited by examiner

ANNULAR SEAL FOR MOTOR VEHICLE HEAT EXCHANGER

BACKGROUND

The present invention relates to the field of seals.

More particularly, it relates to an annular seal intended to be located in a motor vehicle heat exchanger.

A motor vehicle heat exchanger generally comprises a collector box, the collector plate whereof is connected to heat exchanger tubes of a bundle of tubes.

The collector plate is most commonly provided with a channel delimited by two concentric annular edges in which an annular seal is located.

When the plate does not have a channel of this kind, the seal is configured to be stretched between two opposite supports, generally the ends of the outermost tubes of the tube bundle or also of the flanges positioned at the two ends of the bundle.

In the two cases, the seal finds a support, channel, tube or flange on either side of the tube bundle.

This seal therefore comprises two opposite support parts intended to cooperate with the supports, and two connecting parts joining the support parts together.

The seal generally comprises an annular bead extending in the support and connecting parts. This annular bead, having a circular cross section, is intended to be elastically deformed radially by axial compression which is substantially perpendicular to a plane parallel to the annular shape of the seal.

The presence of the deformable joint between the cover of the collector box and the collector plate allows the seal to be made between the cover and the collector plate, between which the seal is compressed.

It will be noted, as specified above, that a circular rather than an oval cross section is generally chosen for the bead.

In fact, when the seal is compressed, the oval section is less stable because it has a tendency to pivot locally in an undesirable manner, something that may lead to sealing defects.

The material from which the seal is made (most commonly a polymer) can be deformed, while still being relatively non-compressible. The capacity of the bead to be flattened is therefore limited by the space assigned to it, in particular by the dimensions of the channel when the seal is placed in it. If the space is not large enough, the seal cannot flatten sufficiently at certain points to balance them out. This may result in sealing defects.

SUMMARY OF DISCLOSURE

The aim of the invention is therefore to avoid these sealing defects and to limit the dimensions of the space assigned to the seal, in particular the dimensions of the channel, in order to limit the size of the heat exchanger.

To this end, the object of the invention is an annular seal for a motor vehicle heat exchanger, intended to be stretched between two opposite supports that it surrounds, comprising:

- two opposite support parts intended to cooperate with the two supports,
- two connecting parts (18) joining the support parts together, and
- an annular bead intended to be deformed elastically by axial compression substantially perpendicular to a plane parallel to the annular shape of the seal, said annular bead extending in the support and connecting parts, characterized in that the cross section of the bead between each support part and the connecting parts to which it is joined changes in such a manner that its dimension, measured in a median plane of the seal parallel to the annular shape of the seal, in other words the radial dimension, is smaller in the support part than in the connecting parts.

As the seal comprises a bead, the cross section whereof has a smaller radial dimension in the support parts, its radial size in the median plane following compression will be smaller.

This allows the width of the channel in which the seal is to be located to be limited; in fact it allows the creep of the bead extending in the connecting parts towards the smaller support parts.

Hence, a seal of this kind therefore allows the manufacturing tolerances of the collector box and of the collector plate to be more effectively balanced and the sealing defects of the heat exchanger thereby to be reduced without having to increase the dimensions thereof, while it remains stable.

Advantageously, each support part comprises a radial extension of the bead forming a support heel on the corresponding support.

The support heel allows the stability of the annular bead in the support parts to be improved still further.

According to a particular embodiment, the annular bead has a circular cross section in the connecting parts.

According to a particular embodiment, the annular bead has an oval cross section in the support parts.

The oval shape provides the bead with available space for the greatest compression, whereas the circular shape gives the bead greater stability.

Moreover, the choice of these sections has the advantage that the transition between these two shapes is easy to achieve and can be done continuously.

Ultimately, it will be noted that in the support parts the bead with the oval section is stabilized by the supports and has less of a tendency to pivot than in the connecting parts.

According to a particular embodiment, whereas the seal is stretched between the two supports:

- the connecting parts are substantially straight,
- each support part comprises a support sub-part which is substantially straight and curved transitional sub-parts between the connecting parts and the support sub-part, and
- the cross section of the bead changes in the transitional sub-parts and is constant in the support sub-parts.

According to a particular embodiment, in the transitional sub-parts the cross section of the bead changes from the adjacent end of the adjacent connecting part up to the adjacent end of the support sub-part.

The invention likewise relates to an exchanger comprising a collector box connected to heat exchange tubes and comprising a cover, a collector plate, and a seal, as previously described, inserted between the cover and the collector plate.

According to a particular embodiment, the complementary member of the exchanger is a collector plate and comprises two channels delimited by an annular external edge common to the two channels and two separate internal edges delimiting the two channels, respectively, the annular seal being disposed in the two channels.

According to a particular embodiment, the support associated with a support part of the seal is formed by the external contour of a first support tube of the heat exchanger, the support part surrounding said first support tube.

In a particular embodiment, each support part rests against a secondary support formed by a second adjacent support tube of the first support tube, in such a manner that said support part comprises a reinforcing part extending between the first and the second support tubes.

The reinforcing part makes it possible to prevent the material of the bead from creeping outside the support parts when the seal is stretched between the two supports. In effect, as the reinforcing part bears against the second support tube, it exerts reactive forces to the stress towards the support parts and allows the creep of the material in the direction of the connecting parties to be resisted.

Advantageously, the collector plate comprises a channel delimited by two substantially concentric annular edges, the annular seal being disposed in the channel.

The invention will be better understood on reading the following description provided simply by way of example and given with reference to the drawings.

DETAILED DESCRIPTION

Figure 1:
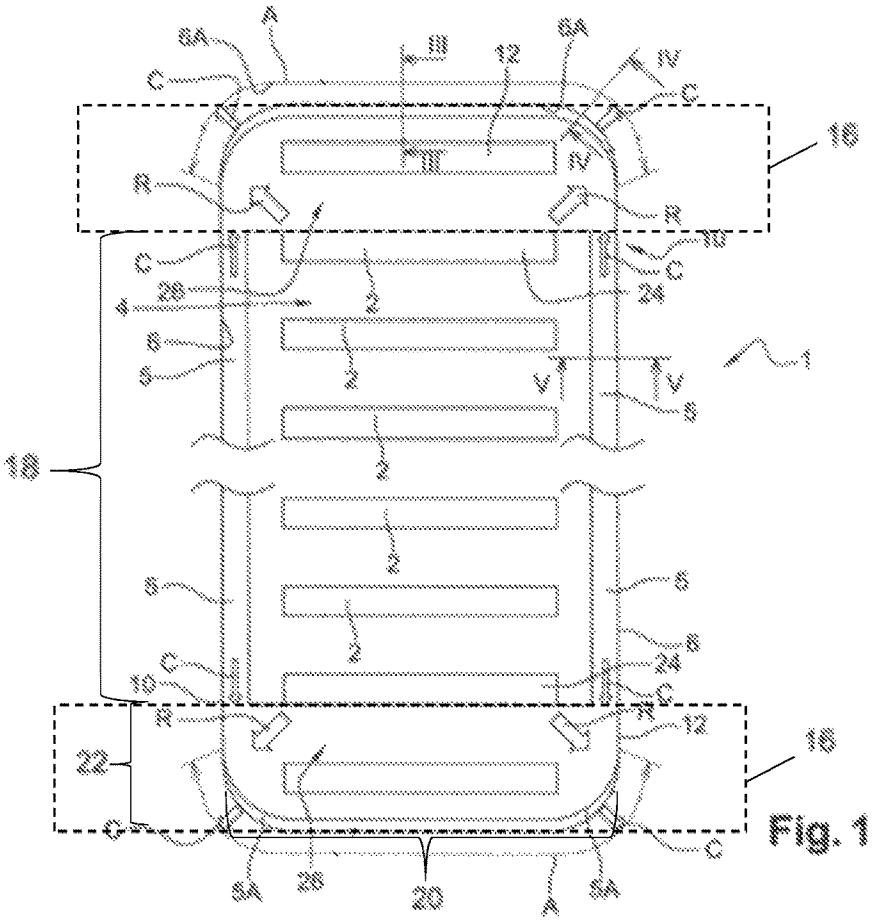
FIG. 1 is a schematic view from above of a seal according to a first embodiment of the invention located in a heat exchanger according to a first embodiment of the invention.

A first embodiment of a heat exchanger 1 according to the invention is depicted in FIG. 1.

The heat exchanger 1 comprises a collector box, or water box, connected to flat heat exchange tubes 2 which are parallel to one another. This collector box comprises a collector plate 4 and a cover. The collector plate 4 is substantially rectangular in shape.

The heat exchanger 1 comprises two seal paths 5 extending along the periphery of the collector plate 4, delimited by an annular outer edge 6, generally substantially rectangular in shape, shared by the two paths 5. Towards the inside, the paths 5 are delimited by the tubes 2.

An annular seal 10 according to a first embodiment of the invention is disposed along two paths 5 in such a manner as to be inserted between the cover foot 11 (partially represented in FIGS. 3 to 5) of the collector box and the collector plate 4. In the figures, the seal is represented before it has been flattened by the cover.

Figure 2:
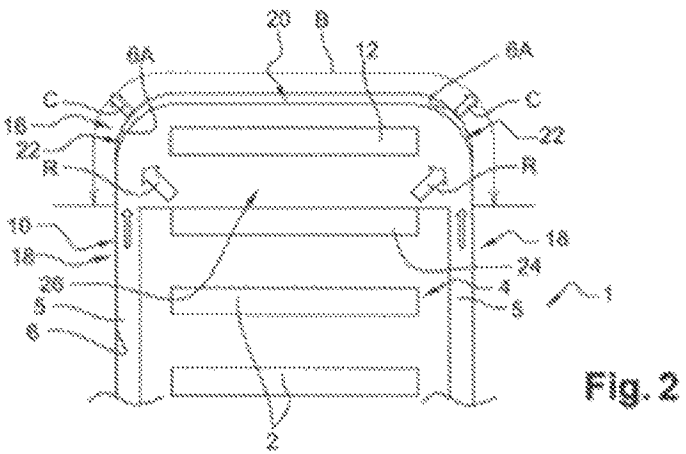
FIG. 2 is a schematic view from above of part of a seal according to a second embodiment of the invention located in an exchanger according to the first embodiment of the invention.

The annular joint 10 is represented in FIGS. 1, 2 and stretched between the outer contours of two support tubes 12. The support tubes 12 are those situated at opposite ends of the bundle of tubes in the heat exchanger 1.

In this stretched position, the annular seal 10 has an annular general shape similar to that of the periphery of the collector plate 4, and is therefore substantially rectangular.

The annular seal 10 comprises an annular bead 14 intended to be elastically deformed by axial compression substantially perpendicular to a plane parallel to the annular form of the seal 10, in other words perpendicular to the plane of the collector plate 4.

The annular seal 10 comprises two opposite support parts 16 each intended to cooperate with the support tubes 12, and two connecting parts 18 linking the support parts 16 together, respectively.

In this stretched position between the two support tubes 12, the connecting parts 18 are substantially straight due to the fact that the seal 10 is substantially rectangular in shape.

Moreover, each support part 16 comprises a support sub-part 20 which is substantially straight and curved transitional sub-parts 22 between the connecting parts 18 and the support sub-part 20.

The cross section of the bead 14 between each support part 16 and the connecting parts 18 to which it is joined changes in such a manner that its dimension measured in a median plane of the seal 10 parallel to the annular form of the seal 10, in other words the radial dimension, is smaller in the support part 16 than in the connecting parts 18.

Hence, in the support parts 16 the bead 14 requires less space to spread out under the effects of compression than in the connecting parts 18.

The bead 14 therefore has space to spread out under the effects of compression in the centrifugal direction indicated by the arrows C, taking account of the annular shape of the seal 10. This allows the seal 10 to create the seal between the collector plate 4 and the cover foot 11 of the collector box (see FIGS. 3 to 5).

Moreover, the bead 14 remains stable in the support parts 16 as it is held by the support tubes 7 and therefore there is little tendency for it to pivot.

The cross section of the bead 1 changes in the transitional sub-parts 22.

Hence, in the first embodiment represented in FIG. 1, the seal exhibits a first section in the support sub-parts 20, a second section in the connecting parts 18, and in the transitional parts it exhibits a changing section between the first section and the second section. More precisely, the seal exhibits in section this second section in the zones situated outside the arrows A.

In a second embodiment of the annular seal 10 depicted in FIG. 2, the cross section of the bead 14 corresponding to the second section is limited to the connecting parts 18, in other words the zone along which the section is changing is slightly longer than that illustrated by the arrow B which extends here up to the start of the connecting parts 18.

In the two embodiments illustrated in FIGS. 1 and 2, the support part 16 is supported against a secondary support formed by a second support tube 24, in such a manner that this support part 16 comprises a reinforcement part 26 extending between the first support tube 7 and the second support tube 24.

When the annular seal 10 is stretched between the support tubes 12, as shown in FIGS. 1 and 2, the material of the bead 14 tends to creep from the support parts 16 towards the connecting parts 18. In order for the material of the seal 10 to be retained as far as possible between the corners 6A forming the transition between the large and small sides, the reinforcement part 26 resting against the second support tube 24 exerts reactive forces R to the tension resisting the creeping of the material of the bead 14 in the direction of the connecting parts 18.

Figure 3:
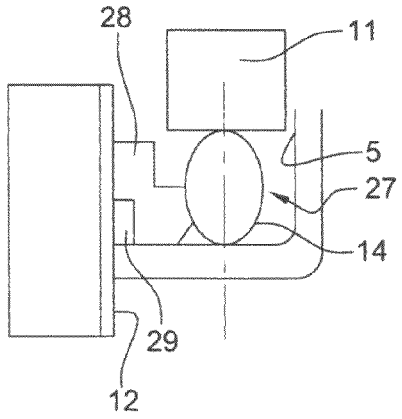
FIG. 3 is a section along line III-III in FIG. 1.
Figure 4:
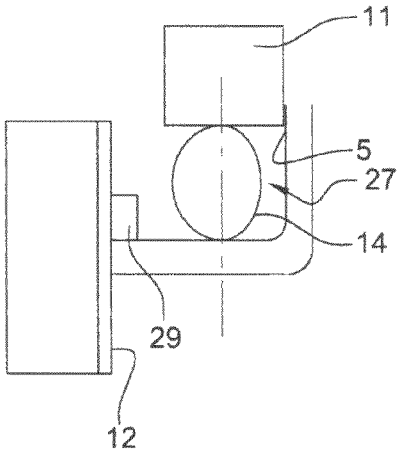
FIG. 4 is a section along line IV-IV in FIG. 1.
Figure 5:
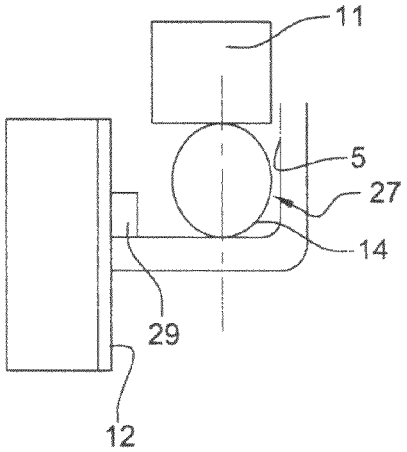
FIG. 5 is a section along line V-V in FIG. 1.

An exemplary change in the cross section of the bead 14 can be seen (in the non-flattened state) in FIGS. 3 to 5.

In the support sub-part 20, the bead 14, as represented in FIG. 3, has a first oval-shaped section.

When the seal 10 is compressed, this oval shape leaves the bead 14 of the support sub-parts 20 a larger deformation space 27 than if it had been circular in section, as is the case with the bead 14 in the connecting parts 18 and, to a lesser extent, the transitional sub-parts 22.

Preferably in each support part 16 and, more particularly, in each support sub-part 20, the seal 10 comprises a radial extension of the bead 14 forming a support heel 28 on the corresponding support tube 12. It will be noted that, in the example illustrated in FIGS. 3 to 5, each tube 2 passes through a collar 29 made in the collector plate 4. Hence, more precisely, the support heel 28 comes to rest on this collar 29 and, above the collar 29, directly on the tube 12. This allows the stability of the bead 14 (the section of which is oval) to be improved by diminishing the risks of it pivoting. The oval shape of the bead 14 moreover allows the space attributed to the seal function to be limited and part of the space available to be given to the support heel.

In the connecting parts 18, the bead 14, as represented in FIG. 5, has a circular-shaped section. Not having a support heel in these parts 18, the seal has more deformation space 27 than in the sub-parts 20, although the total space attributed to the seal is greater in the sub-parts 20 than in the connecting parts 18. This is why it is possible to have a circular section for the seal in the connecting parts 18.

And in these connecting parts 18, the bead 14 is stable thanks to its circular section.

When the seal is flattened by the cover foot 11, it may extend towards the tube 2 and, in particular, towards the collar 29.

In the transitional sub-parts 22, the bead 14, as represented in FIG. 4, has a section changing between the oval shape and the circular shape.

When the seal 10 is compressed, this allows the bead 14 of the transitional sub-parts 22 to be left a larger deformation space 27 than the bead 14 of the connecting parts 18.

In these transitional sub-parts 22, the bead 14 has a deformation space 27 which is likewise larger than in the support sub-parts 20, as the seal does not have a support heel.

According to a variant of the embodiment, the section of the seal in the connecting parts 18 may exhibit another shape, in particular it may be oval with an intermediate shape between the oval of the transitional parts and the circular section.

According to another variant of the embodiment depicted in FIG. 5, the support heel is likewise presented in the transitional sub-parts 22.

Figure 6:
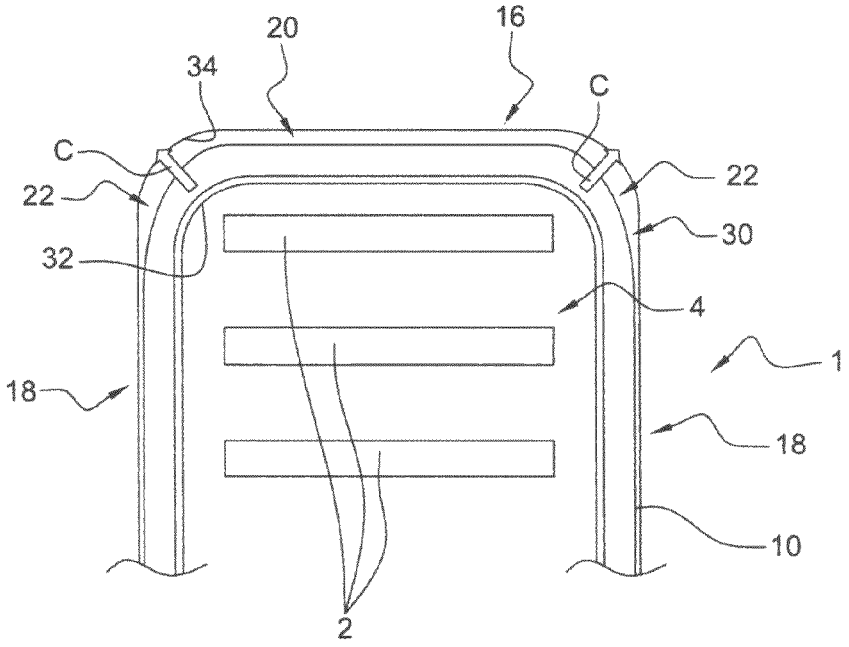
FIG. 6 is a schematic view from above of a seal according to a third embodiment of the invention located in an exchanger according to a second embodiment of the invention.

In a second embodiment of the heat exchanger 1 according to the invention, as represented in FIG. 6, the heat exchanger 1 comprises a peripheral channel 30 delimited by an internal annular edge 32 and an external annular edge 34 which are substantially concentric. In particular, the channel 30 extends over the entire contour of the collecting plate 4.

An annular seal 10 according to a third embodiment of the invention is disposed in the channel 30.

The annular seal 10 is similar to the seal according to the first or the second embodiment, except for the presence of the reinforcing sub-part 26.

In effect, since the channel 30 extends over the entire contour of the collector plate 4 and has a generally annular shape, it allows the material creep imbalances between the connecting parts 18 and the supporting parts 16 to be limited when the seal 10 is compressed.

According to another embodiment which is not shown, the support of the annular seal is created only on the tube. According to another embodiment, the annular seal rests only on the collar.

The invention is not restricted to the embodiments shown and other embodiments will appear clear to the person skilled in the art.

Hence, in variants which are not shown, the cross section of the annular bead changes from a square shape in the connecting parts into a rectangular shape in the support parts.

What is claimed:

1. An exchanger comprising:

a collector box connected to heat exchange tubes, wherein the collector box comprises:

a cover, a collector plate, and a seal inserted between the cover and the collector plate, wherein the seal comprises:

two opposite support parts that cooperate with two supports between which the seal is stretched, two connecting parts joining the support parts together; and an annular bead that deforms elastically by axial compression from the cover substantially perpendicular to a plane parallel to the annular shape of the seal, said annular bead extending in the support and connecting parts into a deformation space parallel to the plane, wherein the annular bead is separate from the cover, wherein the cross section of the annular bead between each support part and the connecting parts to which the annular bead is joined changes such that a radial dimension of the annular bead, measured in a median plane of the seal parallel to the annular shape of the seal, is smaller in the support part than in the connecting parts.

2. The exchanger according to claim 1, wherein the support associated with a support part of the seal is formed by the external contour of a first support tube of the heat exchanger, the support part surrounding said first support tube.

3. The exchanger according to claim 2, wherein each support part rests against a secondary support formed by a second adjacent support tube of the first support tube, such that said support part comprises a reinforcing part extending between the first and the second support tubes.

4. The exchanger according to claim 1, wherein the collector plate comprises a channel delimited by two substantially concentric annular edges, the annular seal being disposed in the channel.

5. An exchanger comprising:

a collector box connected to heat exchange tubes, wherein the collector box comprises:

a cover;

a collector plate comprising a channel delimited by two substantially concentric annular edges; and a seal inserted in the channel and compressed between the cover and the collector plate, wherein the seal comprises:

two opposite support parts that cooperate with two supports between which the seal is stretched, two connecting parts joining the support parts together; and an annular bead having a circular cross section that deforms elastically by axial compression from the cover substantially perpendicular to a plane parallel to the annular shape of the seal, wherein a cross-section of the annular bead has a smaller radial dimension in the support parts, thereby limiting a width of the channel, wherein the annular bead is separate from the cover, wherein the cross section of the annular bead between each support part and the connecting parts to which the annular bead is joined changes such that a radial dimension of the annular bead, measured in a median plane of the seal parallel to the annular shape of the seal, is smaller in the support part than in the connecting parts.

* * * * *